US009956577B2

(12) United States Patent
Schenke et al.

(10) Patent No.: US 9,956,577 B2
(45) Date of Patent: May 1, 2018

(54) COATING SYSTEM HAVING A COOLING DEVICE

(71) Applicant: Durr Systems GmbH, Bietigheim-Bissingen (DE)

(72) Inventors: Bjorn Schenke, Flein (DE); Ralf Schafer, Ludwigsburg (DE); Armin Hoderlein, Freiberg (DE)

(73) Assignee: Dürr Systems GmbH, Bietigheim-Bissingen (DE)

( * ) Notice: Subject to any disclaimer, the term of this patent is extended or adjusted under 35 U.S.C. 154(b) by 0 days. days.

(21) Appl. No.: 14/782,645

(22) PCT Filed: Apr. 7, 2014

(86) PCT No.: PCT/EP2014/000925
§ 371 (c)(1),
(2) Date: Oct. 6, 2015

(87) PCT Pub. No.: WO2014/166618
PCT Pub. Date: Oct. 16, 2014

(65) Prior Publication Data

US 2016/0067731 A1 Mar. 10, 2016

(30) Foreign Application Priority Data

Apr. 12, 2013 (DE) ..... 10 2013 006 334

(51) Int. Cl.
*B05C 5/00* (2006.01)
*B05C 11/10* (2006.01)
(Continued)

(52) U.S. Cl.
CPC ..... *B05C 5/001* (2013.01); *B05B 9/002* (2013.01); *B05B 9/0409* (2013.01);
(Continued)

(58) Field of Classification Search
CPC ..... B05C 5/001; B05C 11/1039; B05C 11/1042; B05B 9/002; B05B 9/0409;
(Continued)

(56) References Cited

U.S. PATENT DOCUMENTS 3,607,553 A 9/1971 Fritzsche
4,173,924 A * 11/1979 Bradshaw ..... B05B 15/1222 118/326
(Continued)

FOREIGN PATENT DOCUMENTS

CN 102198337 A 9/2011
DE 2008716 A1 9/1970
(Continued)

OTHER PUBLICATIONS

International Search Report and Written Opinion for PCT/EP2014/000925 dated Jul. 17, 2014 (with English translation of ISR; 12 pages).
(Continued)

*Primary Examiner* — Laura Edwards
(74) *Attorney, Agent, or Firm* — Bejin Bieneman PLC

(57) ABSTRACT

The disclosure relates to a paint system for coating components with a coating medium, in particular a painting system for painting motor vehicle bodywork components with a paint, comprising at least one pneumatic pump for circulating paint in the system. The pneumatic pump includes a feed air connection for feeding in a feed air stream for mechanically powering the pump and an exhaust air connection for conducting away a depressurised, cold exhaust air stream. The cold exhaust stream passing through a first heat exchanger where the heat exchanger cools a medium in a cooling circuit and the medium cools a heat-sensitive component. The heat sensitive component can be the paint circulation lines or a protective housing for the robot.

10 Claims, 2 Drawing Sheets

(51) Int. Cl.

| | |
|---|---|
| ***F28D 21/00*** | (2006.01) |
| ***B05B 9/04*** | (2006.01) |
| ***B05B 9/00*** | (2006.01) |
| *B05B 15/12* | (2006.01) |

(52) U.S. Cl.
CPC ..... *B05C 11/1039* (2013.01); *B05C 11/1042* (2013.01); *F28D 21/0003* (2013.01); *F28D 21/0014* (2013.01); *B05B 15/1222* (2013.01)

(58) Field of Classification Search
CPC ..... B05B 15/1222; F28D 21/0003; F28D 21/001; F28D 21/0014; F04B 43/06; F04B 43/067; F04B 45/041; Y10S 901/00
USPC ..... 118/69, 326, 323; 101/487; 165/104.19, 165/104.28, DIG. 12; 417/392–395; 62/314
See application file for complete search history.

(56) References Cited

U.S. PATENT DOCUMENTS 4,351,482 A 9/1982 Sugiyama et al.
4,422,370 A * 12/1983 Gustavson ..... B05B 15/1222 165/103
4,551,037 A * 11/1985 Kille ..... B05C 17/0333 310/16
7,908,994 B2 * 3/2011 Herre ..... B05B 5/1633 118/300
7,975,935 B2 * 7/2011 Matheis, Jr. ..... B05B 7/24 118/300
2011/0217474 A1 * 9/2011 McGough ..... B05D 1/02 427/421.1

FOREIGN PATENT DOCUMENTS

| | | | |
|---|---|---|---|
| DE | 2907310 | A1 | 9/1979 |
| DE | 10234915 | A1 | 2/2004 |
| DE | 10318004 | B3 | 12/2004 |
| EP | 1449416 | B1 | 8/2005 |
| EP | 2359940 | A1 | 8/2011 |
| WO | 2009030308 | A1 | 3/2009 |

OTHER PUBLICATIONS

Certificate of Invention Patent for CN Patent No. ZL 201480020580.9 dated Sep. 5, 2017 (11 pages).

* cited by examiner

COATING SYSTEM HAVING A COOLING DEVICE

CROSS-REFERENCE TO RELATED APPLICATIONS

This application is a national stage of, and claims priority to, Patent Cooperation Treaty Patent Application No. PCT/EP2014/000925, filed on Apr. 7, 2014, which claims priority to German Application No. DE 10 2013 006 334.5 filed on Apr. 12, 2013, each of which applications are hereby incorporated herein by reference in their entireties.

BACKGROUND

In modern painting systems for painting vehicle bodywork components, pneumatically powered paint supply pumps which are arranged in a paint supply room of the painting system are often used to convey the paint to be applied. Such paint supply pumps are driven by compressed air which is then conducted away from the paint supply pump via an exhaust air connection. One possibility for conducting away the exhaust air from the paint supply pumps lies in releasing the air via a muffler into the surrounding air. Another possibility for conducting away the exhaust air from the paint supply pumps lies in collecting the air via air channels in the paint supply room and then releasing it to the outside. In both cases, however, the exhaust air from the pneumatically powered paint supply pumps is not further used.

Furthermore, reference is made, with regard to the prior art, to DE 20 08 716 A, EP 2 359 940 A1, EP 1 449 416 B1 and DE 29 07 310 A1. However, these documents do not disclose coating systems in which the exhaust air of the pneumatically powered paint supply pump is used in any way.

SUMMARY

A coating system for coating components with a coating medium may take the form of a painting system for painting vehicle bodywork components with a paint.

The present disclosure is based on the technical/physical finding that the exhaust air from the pneumatically powered paint supply pumps is depressurised and, due to the expansion, cools down. The cold exhaust air stream of the pneumatically powered pumps can therefore be used for cooling purposes.

Accordingly, a cooling device is provided which cools a heating-sensitive component (e.g. paint circuit line, railhouse) of the coating system by means of the cold exhaust air stream of the pump.

For this purpose, the cooling device can have at least one first heat exchanger to transfer heat from the heating-sensitive component (e.g., paint circuit line, railhouse) of the coating system to the cold exhaust air stream of the pump such that the heating-sensitive component of the coating system is cooled. Depending on the cooling power required, it is also possible that a plurality of heat exchangers are connected in series.

In one variant, the first heat exchanger is an air/air heat exchanger, i.e., both the heat feed on the warm side and the heat removal on the cold side of the heat exchanger takes place by means of an air stream.

In another variant, however, the first heat exchanger is an air/water heat exchanger, i.e., on the cold side of the heat exchanger, an air stream is fed through the heat exchanger, specifically the cold exhaust air stream of the pump, whereas on the warm side of the heat exchanger, a water stream is fed through the heat exchanger.

With regard to the design of the heat exchanger, the heat exchanger can be a recuperator, i.e., a heat exchanger with an indirect heat transfer between the cold side and the warm side and a substance separation between the cold side and the warm side.

In one example, the cooling device has a cooling circuit which connects the heating-sensitive component of the coating system to the first heat exchanger, wherein the cooling circuit contains a cooling medium (e.g., air, water) to transport the heat to be removed from the heating-sensitive component of the coating system to the first heat exchanger.

The cooling medium is conveyed in the cooling circuit, preferably by a pump in circulating operation.

It was briefly mentioned above that the heating-sensitive component of the coating system can be, for example, a pipeline, for example, a coating medium line or a paint circuit line. Such pipelines are per se known from conventional coating systems or painting systems and therefore need not be described in detail.

In an example, the cooling circuit is connected by a second heat exchanger to the respective coating medium line, wherein the second heat exchanger transfers the heat to be removed from the coating medium line to the cooling circuit from where the heat to be removed is then transferred by the first heat exchanger to the cold exhaust air stream of the pump.

In another example, the heating-sensitive component of the coating system is a "railhouse", i.e. a protective housing which surrounds a travel axis of a robot (e.g. paint robot, handling robot). Railhouses of this type are described, for example, in DE 102 34 915 A1 and belong to the common general knowledge of a person skilled in the art so that a detailed description is not necessary. In this example, the cooling circuit conducts cold air into the protective housing, sometimes referred to as the "railhouse" as noted above, and conducts warm air out of the protective housing to reduce the internal temperature of the protective housing.

Further, the cooling of the compressed air which serves to power the pump can lead to condensation of water or ice formation on the components of the system which come into contact with the depressurised, cold exhaust air of the pump. In an example, the cold air line connected to the exhaust air connection of the pump is provided at the outside thereof with a thermal insulation to prevent condensation water build-up or frost formation on the outside of the cold air line. The present disclosure of thermal insulation of the cold air line can have application independently of a cooling device.

Further, the coating system according to the invention can have a plurality of pneumatically powered pumps which each have an exhaust air connection, wherein the exhaust air connections of the pumps open into a common cold air line which can be connected to the first heat exchanger.

Many possibilities exist with regard to the design and function of the pneumatically powered pump. For example, and without limitation, the pneumatic pump can be designed as a piston pump or as a membrane pump.

Further, the pneumatically powered pumps can be arranged in a paint mixing room of the coating system, which is per se known from the prior art and therefore need not be described in detail.

Furthermore, the possibility also exists that the cold exhaust air stream of the pneumatic pump can be conducted, without an interposed heat exchanger, directly onto the heating-sensitive component of the coating system, which enables the use of the cold of the exhaust air without significant additional effort.

It was briefly mentioned above that the heating-sensitive component of the coating system can be, for example, a pipeline, or a "railhouse". Another example of the heating-sensitive component of the coating system is a paint booth. The internal space of a painting booth must usually be air-conditioned so that the painting within the paint booth takes place under climatic conditions that are as constant as possible, which is important for an optimum painting result. The cold exhaust air of the pneumatically powered pumps can therefore also be used for cooling or air-conditioning the painting system so that the energy usage for air-conditioning the paint booth can be substantially reduced. This is of special significance because the energy consumption of a painting system accounts for a large part of the entire energy consumption of a motor vehicle plant.

The present disclosure further encompasses a cold exhaust air stream of a pneumatically powered pump for cooling a heating-sensitive component of a coating system.

Other advantageous developments of are disclosed in the subclaims or are described below in greater detail together with the description making reference to the drawings, in which:

FIG. 1 shows a first exemplary embodiment of a painting system for painting motor vehicle bodywork components, wherein the painting system is largely conventionally designed, so that a detailed description of the design and the function of the painting system can be dispensed with and it is only the parts of the painting system that are essential to the disclosure that are described below.

The painting system has a plurality of paint circuit lines 1-5 in which paints of different colours are conveyed in a circulating manner in order to prevent deposition of the paints in the circuit lines 1-5.

The paint circuit lines 1-5 each extend through heat exchangers 6-10 which can be configured, for example, as pipe-in-pipe heat exchangers and have the purpose of cooling the paint in the individual paint circuit lines 1-5.

The heat exchangers 6-10 are connected to a common cooling circuit 11 which contains water as the cooling medium, the cooling water being conveyed in the cooling circuit 11 by a pump 12 in circulating operation.

The cooling circuit 11 extends through a further heat exchanger 13 which is an air/water heat exchanger.

On the cold side of the heat exchanger 13, a cold air line 14 extends through the heat exchanger 13, wherein the cold air line 14 is supplied with cold air from exhaust air connections 15-21 from a plurality of pneumatically powered paint supply pumps 22-28.

The powering of the paint supply pumps 22-28 is carried out by means of compressed air which is fed, in each case, by a feed air connection 29-35.

The paint supply pumps 22-28 can be configured in conventional manner as a diaphragm pump or as a piston pump so that a detailed description of the paint supply pumps 22-28 can be dispensed with.

However, it should be mentioned that the paint supply pumps 22-28 can be arranged in a paint mixing room of the painting system.

During operation of the paint supply pumps 22-28, the compressed air fed in by means of the feed air connections 29-35 is depressurised and thereby cooled, so that cold air is delivered by means of the exhaust air connections 15-21 into the cold air line 14.

In the heat exchanger 13, the cold air then absorbs heat from the cooling water in the cooling circuit 11, such that the temperature of the cooling water in the cooling circuit 11 is reduced.

The heat exchangers 6-10 then transfer heat from the paint into the paint circuit lines 1-5 to the cooling water in the cooling circuit 11, by which the paint in the paint circuit lines 1-5 is cooled.

Figure 1:
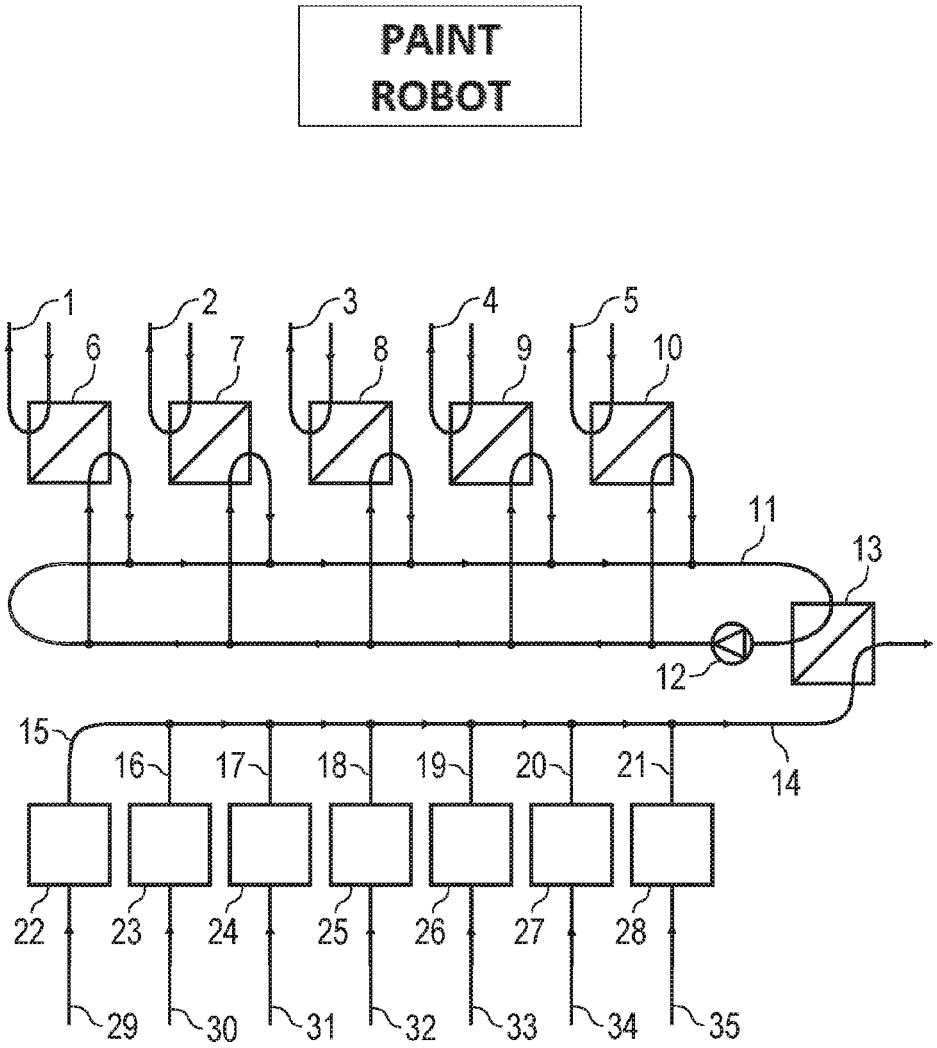
FIG. 1 shows a schematic representation of an exemplary painting system with numerous pneumatically powered pumps, the exhaust air of which is used for cooling paint circuit lines.
Figure 2:
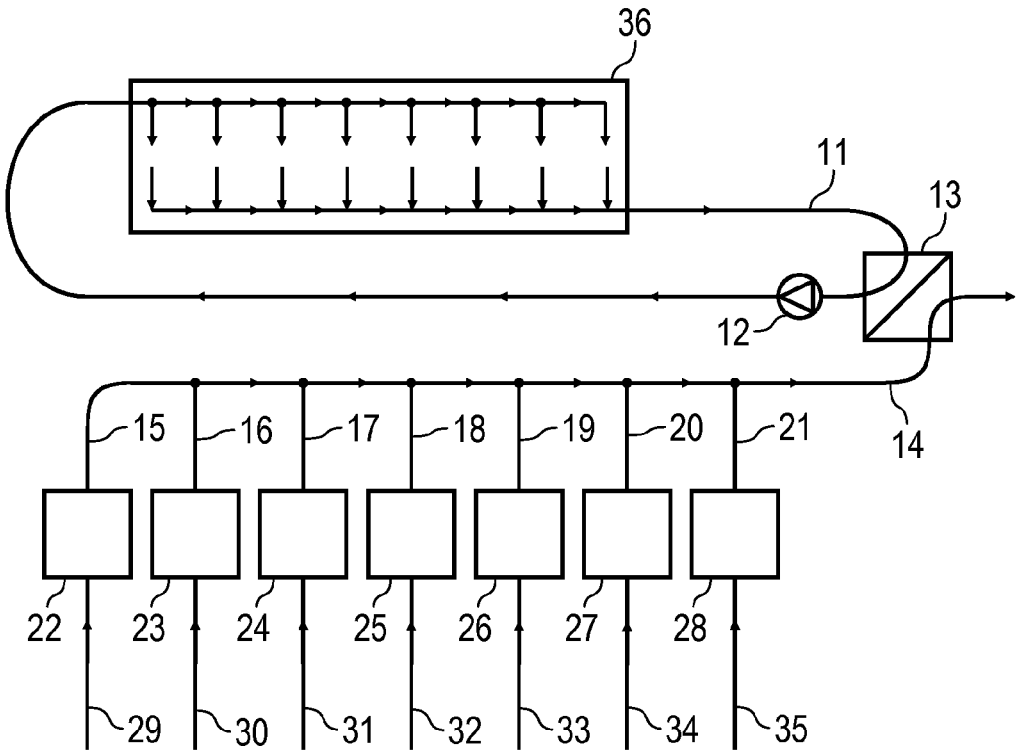
FIG. 2 shows a modification of FIG. 1, wherein the cold exhaust air of the pumps is used for cooling a railhouse.

FIG. 2 shows a modification of the exemplary embodiment according to FIG. 1 described above, so that, for the avoidance of repetition, reference is made to the above description, wherein the same reference signs are used for corresponding details.

A peculiarity of this exemplary embodiment lies therein that a railhouse 36, i.e. a protective housing which surrounds a travel axis of a robot (paint robot or handling robot) of the painting system, is cooled.

A further peculiarity lies therein that the cooling medium in the cooling circuit 11 is air, so that the additional heat exchangers 6-10 can be dispensed with in the exemplary embodiment according to FIG. 1.

The cold air circulating in the cooling circuit 11 is thereby fed into the rail house 36 and heated. The heated air is then fed back again into the cooling circuit 11 and cooled again in the heat exchanger 13.

Figure 3:
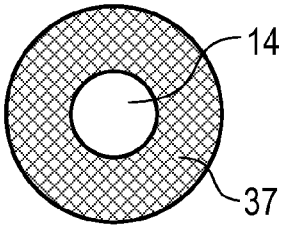
FIG. 3 shows a cross-sectional view through a cold air line with a surrounding thermal insulation.

Finally, FIG. 3 shows a simplified cross-sectional view through the cold air line 14 which is provided at the outside thereof with a thermal insulation 37. The thermal insulation 37 is intended to achieve that the outside temperature at the outer surface of the thermal insulation 37 is sufficiently great despite the low temperature of the cold air line 14 to prevent troublesome condensation water or ice formation on the outer surface of the thermal insulation 37.

The invention is not restricted to the above-described preferred exemplary embodiments. Rather a plurality of variants and modifications is possible which also make use of the inventive concept and therefore fall within the scope of protection. Furthermore, the invention also claims protection for the subject matter and the features of the subclaims separately from the claims to which they refer. In particular, the invention also claims independent protection for the concept of a thermal insulation of the cold air line to prevent the troublesome formation of condensation water or ice.

The invention claimed is:

1. A paint system for painting components with a paint, comprising:

a plurality of pneumatic pumps, the pneumatic pumps configured to supply a plurality of paints having different colours, the pneumatic pumps all having a feed air connection to provide a feed air stream for mechanically powering each pump, and each pump having an exhaust air connection for conducting away a depressurised, exhaust air;

a first heat exchanger that receives the depressurized exhaust air; the heat exchanger cooling a medium in a cooling circuit;

a heat-sensitive component that is cooled by the cooling circuit wherein the heat-sensitive component communicates with a paint robot for coating components with paint.

2. The paint system of claim 1, wherein the cooling circuit has a plurality of second heat exchangers to transfer heat from the heating-sensitive component to the medium.

3. The paint system of claim 2, wherein the exhaust air connection of the pump is connected by means of a cold air line to the first heat exchanger;

the cold air line has a thermal insulation on the outside thereof, said thermal insulation extending over a majority of the length of the cold air line.

4. The paint system of claim 1, wherein the first heat exchanger is an air/air heat exchanger.

5. The paint system according to claim 1, wherein the first heat exchanger is an air/water heat exchanger.

6. The paint system of claim 1 wherein the cooling medium in the cooling circuit is air.

7. The paint system of claim 1, wherein the cooling medium in the cooling circuit is water.

8. The paint system of claim 1, wherein:

the heating-sensitive component of the paint system is a plurality of paint circulation lines each paint circulation line having different colour of paint;

the cooling circuit including a plurality of second heat exchangers with each of the second heat exchangers configured to remove heat from of the paint circulation lines.

9. The paint system of claim 1, wherein:

the heating-sensitive component of the paint system is a protective housing; and the cooling circuit introduces cold air into the protective housing and conducts warm air out of the protective housing.

10. The paint system of claim 9, wherein the protective housing surrounds a travel axis of the robot.

* * * * *